US011152743B2

(12) United States Patent
Sun et al.

(10) Patent No.: US 11,152,743 B2
(45) Date of Patent: Oct. 19, 2021

(54) TRANSMISSION HIGH-VOLTAGE CONNECTOR

(71) Applicant: Ningbo Luokexin Auto Parts Co., Zhejiang (CN)

(72) Inventors: Guoqing Sun, Zhejiang (CN); Yongping Geng, Zhejiang (CN); Xiaoming Chen, Zhejiang (CN)

(73) Assignee: Ningbo Luokexin Auto Parts Co., Zhejiang (CN)

( * ) Notice: Subject to any disclaimer, the term of this patent is extended or adjusted under 35 U.S.C. 154(b) by 0 days.

(21) Appl. No.: 15/931,606

(22) Filed: May 14, 2020

(65) Prior Publication Data

US 2020/0366027 A1 Nov. 19, 2020

(30) Foreign Application Priority Data

May 15, 2019 (CN) ..... 201910402825.9

(51) Int. Cl.

| | |
|---|---|
| ***H01R 13/53*** | (2006.01) |
| ***H01R 13/03*** | (2006.01) |
| ***H01R 13/502*** | (2006.01) |
| ***H01R 13/52*** | (2006.01) |

(52) U.S. Cl.

CPC ..... *H01R 13/53* (2013.01); *H01R 13/03* (2013.01); *H01R 13/5025* (2013.01); *H01R 13/521* (2013.01)

(58) Field of Classification Search

CPC .. H01R 13/748; H01R 13/5202; H01R 13/53; H01R 13/03; H01R 13/5025; H01R 13/521

USPC ..... 439/556, 559, 564, 573, 908

See application file for complete search history.

(56) References Cited

U.S. PATENT DOCUMENTS

| | | | | |
|---|---|---|---|---|
| 3,241,097 A * | 3/1966 | Ege | H01R 33/94 | 439/709 |
| 5,108,296 A * | 4/1992 | Takano | H01R 4/64 | 403/408.1 |
| 6,752,659 B2 * | 6/2004 | Nakamura | H01R 13/5208 | 439/275 |
| 6,916,203 B2 * | 7/2005 | Oyamada | H01R 13/502 | 439/263 |
| 8,128,431 B2 * | 3/2012 | Kato | H01R 13/426 | 439/587 |
| 8,187,030 B2 * | 5/2012 | Matsuoka | H01R 13/5202 | 439/542 |

(Continued)

*Primary Examiner* — Gary F Paumen
(74) *Attorney, Agent, or Firm* — JCIP Global Inc.

(57) ABSTRACT

The present invention provides a transmission high-voltage connector for circuit connection of a transmission of a new-energy vehicle, the transmission comprising a box body and a high-voltage connector covering an opening of the box body, the high-voltage connector comprises a housing, at least one reinforcing sheet and a copper bar, and the copper bar is inserted into and connected to the housing; wherein, the housing is an N-sided polygon, and at most N-1 fixing holes are formed in the housing at positions where two side lines are connected; and at positions where two side lines are connected while no fixing hole is formed, the housing embraces and is connected to the reinforcing sheet. The transmission high-voltage connector provided by the present invention is simple in structure, and has enhanced strength and high-temperature deformation resistance.

6 Claims, 6 Drawing Sheets

(56) References Cited

U.S. PATENT DOCUMENTS

| | | | | |
|---|---|---|---|---|
| 8,241,061 | B2 * | 8/2012 | Chazottes | H01R 13/5205 439/587 |
| 8,430,696 | B2 * | 4/2013 | Matsumoto | H01R 13/521 439/733.1 |
| 8,514,581 | B2 * | 8/2013 | Hasegawa | H05K 3/0064 361/749 |
| 8,771,013 | B2 * | 7/2014 | Kalayjian | H01R 13/5808 439/585 |
| 9,017,099 | B2 * | 4/2015 | Ikeda | H01R 13/521 439/559 |
| 9,407,049 | B2 * | 8/2016 | Ishibashi | H01R 13/748 |
| 2012/0258635 | A1 * | 10/2012 | Osawa | H01R 13/50 439/660 |
| 2015/0079839 | A1 * | 3/2015 | Takemura | H01R 13/74 439/559 |

* cited by examiner

TRANSMISSION HIGH-VOLTAGE CONNECTOR

CROSS-REFERENCE TO RELATED APPLICATION

This application claims the priority benefit of China application serial no. 201910402825.9, filed on May 15, 2019. The entirety of the above-mentioned patent application is hereby incorporated by reference herein and made a part of this specification.

BACKGROUND

Technical Field

The present invention relates to a high-voltage connector, in particular, to a high-voltage connector applicable to a circuit connection system of a transmission of a new-energy vehicle.

Description of Related Art

With the development and process of science and technology, automotive products are changing rapidly, and higher requirements are also placed on circuit connector products. It is an important field of automotive parts for China's automotive industry to participate in globalization.

For a new-energy vehicle, a high-voltage connector mounted on the transmission of the vehicle plays an important role. Under high-voltage and high-current conditions, good sealing performance and reliable power distribution and conduction become the core and key to the safety of new-energy vehicles. In the prior art, the housing of the high-voltage connector is made of plastics, and under high-temperature and low-temperature alternating conditions (the ambient temperature of the transmission is up to 150 degrees Celsius), if there is no space to mount and fix screws for some corners, the plastic parts would deform due to insufficient strength, which causes seal failure; and the dimensional stability is poor.

Therefore, the existing high-voltage connectors need to be improved.

SUMMARY

Aiming at the above defects, the present invention provides a high-voltage connector which is reliable and stable in structure and is applicable to a circuit connection system of a transmission of a new-energy vehicle, so as to solve the technical problems in the prior art.

In order to achieve the above objective, the present invention adopts the following technical scheme:

provided is a transmission high-voltage connector for circuit connection of a transmission of a new-energy vehicle, the transmission comprising a box body and a high-voltage connector covering an opening of the box body, the high-voltage connector comprises a housing, at least one reinforcing sheet and a copper bar, and the copper bar is inserted into and connected to the housing; wherein, the housing is an N-sided polygon, and at most N-1 fixing holes are formed in the housing at positions where two side lines are connected; and at positions where two side lines are connected while no fixing hole is formed, the housing embraces and is connected to the reinforcing sheet.

According to a transmission high-voltage connector in a preferred embodiment of the present application, the reinforcing sheet is a spring metal sheet forming an angle.

According to a transmission high-voltage connector in a preferred embodiment of the present application, the reinforcing sheet comprises a projected reinforcing portion, a recess is formed in the housing at a position corresponding to the projected reinforcing portion, and the recess comprises a recess projection at a bottom surface of the recess.

According to a transmission high-voltage connector in a preferred embodiment of the present application, the copper bar comprises at least two copper sheets, a stepped through hole is formed in the housing at a position where the housing is connected to each copper sheet, and the stepped through hole has a larger diameter at an upper side than that at a lower side.

According to a transmission high-voltage connector in a preferred embodiment of the present application, the transmission high-voltage connector further comprises at least two sealing rings and at least two sealing gaskets, wherein the sealing rings and the sealing gaskets are connected to the upper sides of the stepped through holes, the copper sheets are inserted into and connected to the sealing rings and the sealing gaskets, and the sealing gaskets are tightly connected to the stepped through holes.

According to a transmission high-voltage connector in a preferred embodiment of the present application, the housing further comprises at least two partition ribs each of which is an L-shaped sheet projected from the housing, and the partition ribs are located at the upper sides of the stepped through holes at positions corresponding the copper sheets.

According to a transmission high-voltage connector in a preferred embodiment of the present application, the housing further comprises at least two slide grooves each of which is a concave sheet projected from the housing, and the slide grooves are located at the lower sides of the stepped through holes at positions corresponding the copper sheets.

The design concept of the present application is that the high-voltage connector for the circuit of the transmission is redesigned with a main purpose of enhancing the strength of the housing of the connector, and the reinforcing sheet made of spring metal is additionally provided at positions prone to deformation, and the reliability of assembly is also increased.

Due to the above technical features, compared with the prior art, the present invention has the following advantages and beneficial effects:

firstly, the transmission high-voltage connector of the present application is simple in structure, and the reinforcing sheet increases the strength and provides high-temperature deformation resistance; and secondly, with the design of the stepped through holes and the slide grooves, the assembly is simplified, and the reliability is increased.

Of course, any particular embodiment implementing the teachings of the present invention does not necessarily have all of the above technical effects at the same time.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Some preferred embodiments of the present invention will be described in detail below with reference to the accompanying drawings, but the present invention is not limited to these embodiments only. The present invention is intended to cover any alternatives, modifications, equivalents, and schemes made in the spirit and scope of the present invention. In the following detailed description of the preferred embodiments of the present invention, specific details are set forth in order to provide a thorough understanding of the present invention, and the present invention may be fully understood by those skilled in the art without the description of such details. In other instances, well-known methods, processes, procedures, elements, etc. have not been described in detail in order to avoid unnecessarily obscuring the present invention.

Figure 1:
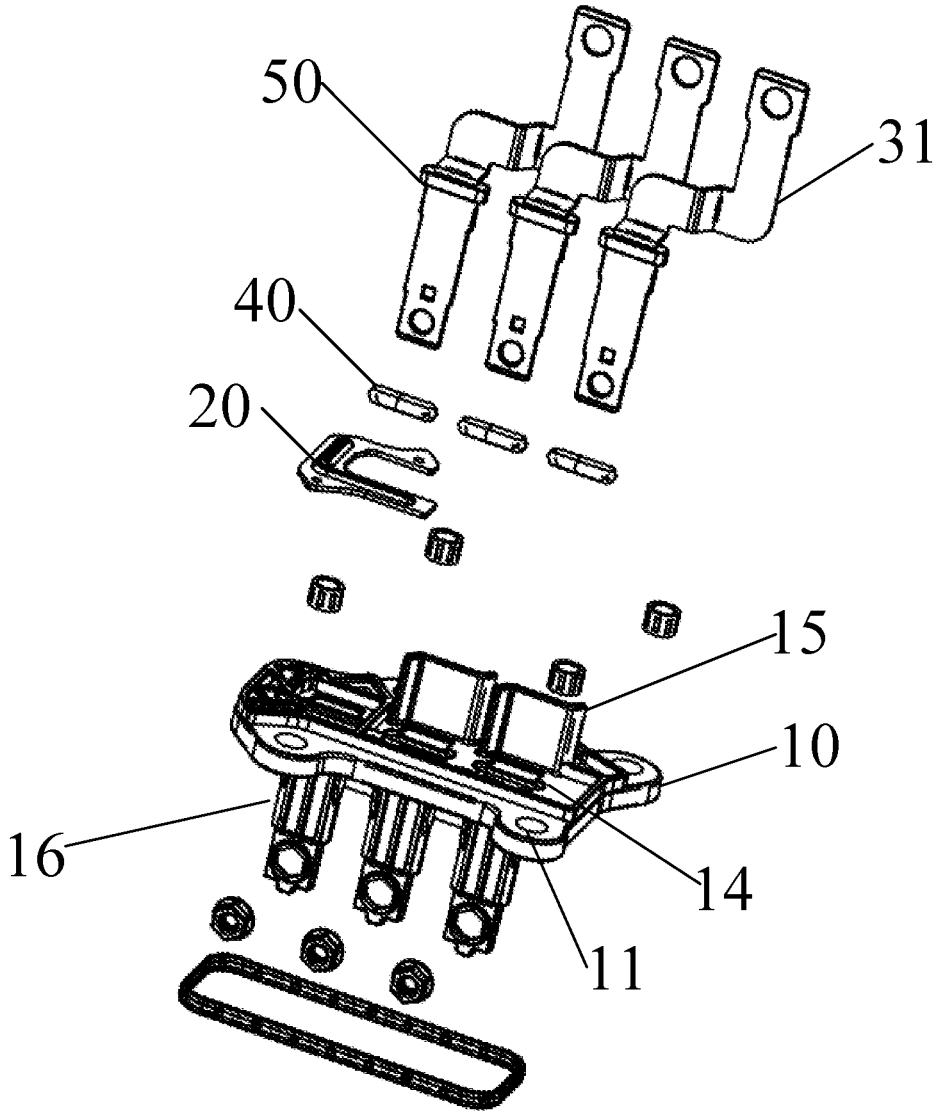
FIG. 1 is an exploded schematic diagram of a high-voltage connector of the present application.
Figure 2:
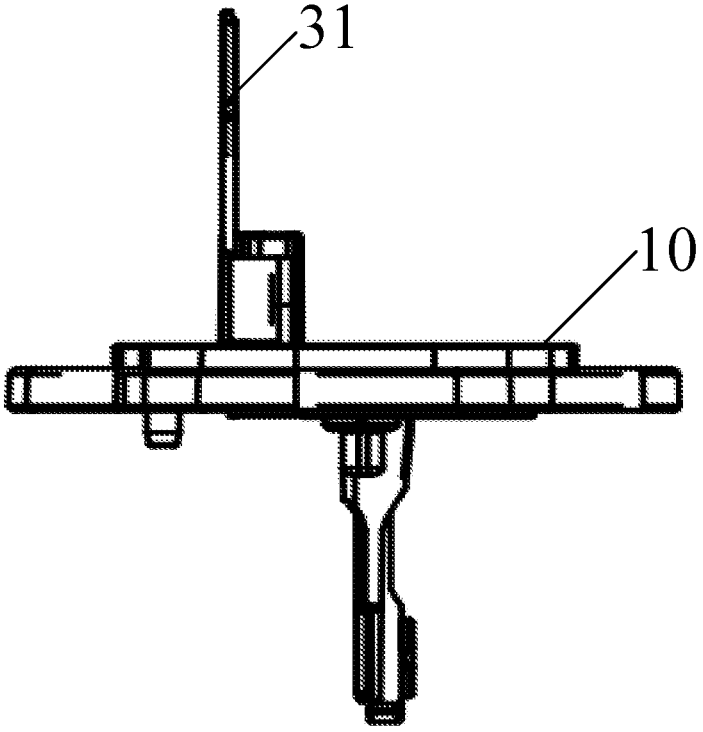
FIG. 2 is a side schematic diagram of the high-voltage connector of the present application.
Figure 3:
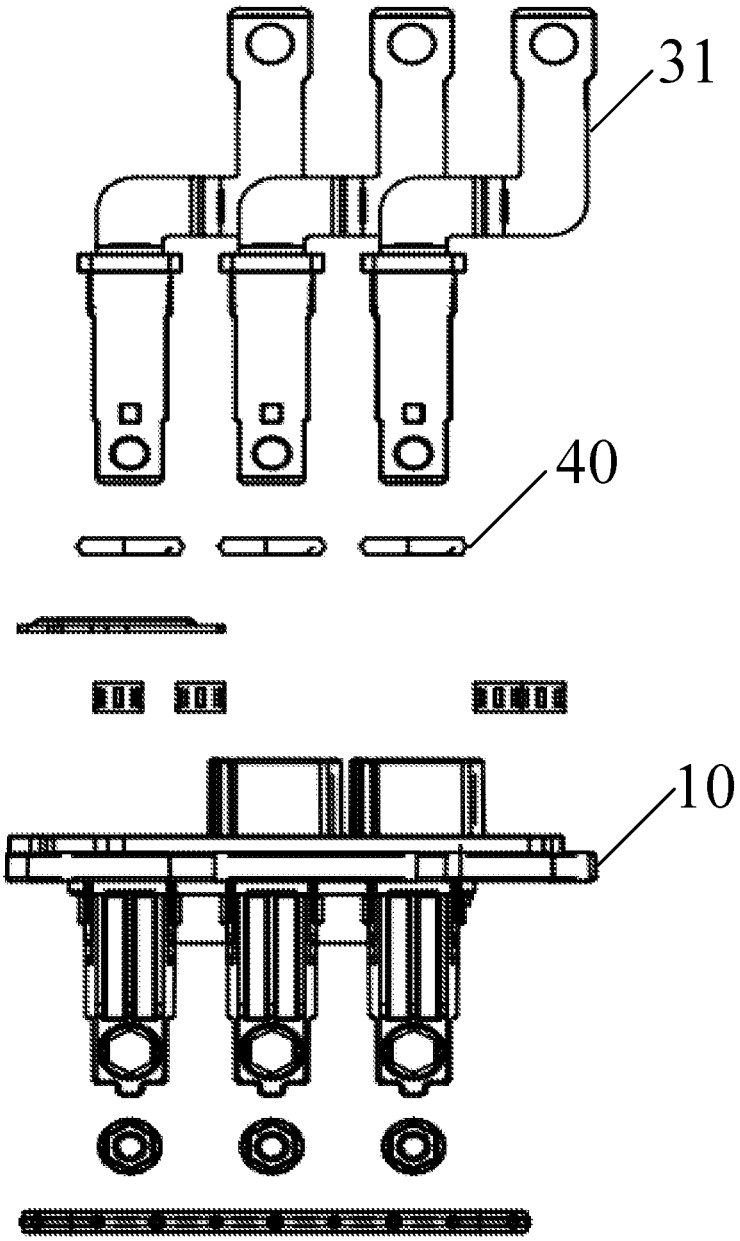
FIG. 3 is an exploded schematic diagram, viewed from another angle, of the high-voltage connector of the present application.

Referring to FIGS. 1, 2 and 3, a high-voltage connector of the present application is shown, the present application provides a transmission high-voltage connector for circuit connection of a transmission of a new-energy vehicle, the transmission comprises a box body (not shown) and a high-voltage connector covering an opening of the box body, the high-voltage connector comprises a housing 10, at least one reinforcing sheet 20 and a copper bar, and the copper bar is inserted into and connected to the housing 10; wherein, the housing 10 is an N-sided polygon, and at most N-1 fixing holes 11 are formed in the housing 10 at positions where two side lines are connected; and at positions where two side lines are connected while no fixing hole 11 is formed, the housing 10 embraces and is connected to the reinforcing sheet 20. In other words, N corners are formed by N sides of the housing 10, and at least one of such corners is provided with no fixing hole 11 formed besides it, because there is no space; the purpose of providing the fixing holes 11 is to lock the housing 10 and the box body with screws, so that oil in the box body cannot leak out, and the housing 10 which is deformed by heating can be recovered; and as described above, the ambient temperature of the transmission can reach up to 150 degrees Celsius, and under such a high temperature, the housing 10 made of plastics may be gradually deformed at corners which are not locked by screws, and finally, gaps may be created between the housing 10 and the box body, resulting in failures. Therefore, in order to solve this problem, at positions of the corners with no fixing holes 11, the housing 10 embraces therein and is connected to the reinforcing sheet 20. As shown in the figures, the housing 10 of the present application is pentagonal and has five corners, in which four corners are provided with the fixing holes 11 while one corner is provided with no fixing hole 11 due to the limitation of space design.

Figure 4:
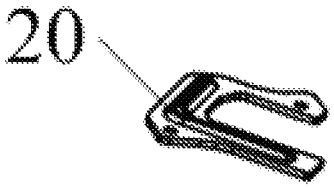
FIG. 4 is a schematic diagram of a reinforcing sheet.

Preferably, referring to FIG. 4, which is a schematic diagram of the reinforcing sheet, the reinforcing sheet 20 is a spring metal sheet forming an angle, and the angle is matched with the angle of the corners of the housing. The reinforcing sheet 20 may be L-shaped or U-shaped, and as shown in the figure, the reinforcing sheet 20 in this embodiment of the present application is U-shaped. In order to enhance the bending strength, the reinforcing sheet 20 extends to the positions of the fixing holes 11 and is provided with through holes at corresponding positions, so that when the housing 10 and the box body are locked by screws, the reinforcing sheet 20 can be locked together so as to improve the bending strength. In addition, in the aspect of material selection, a general metal material can be used, but spring metal materials, such as stainless steel, stainless iron, spring steel, etc., may provide better recovery effects.

Figure 5:
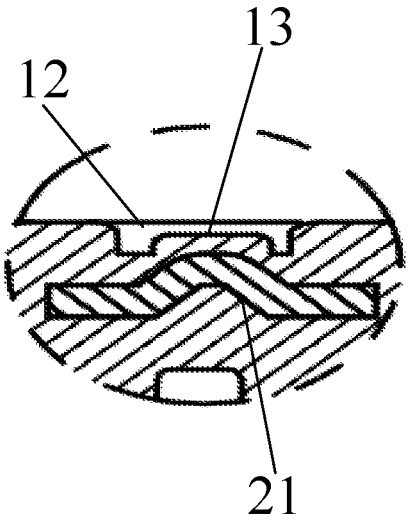
FIG. 5 is a schematic diagram of a projected reinforcing portion.

Further, as shown in FIG. 5, with an enhanced effect, the reinforcing sheet 20 comprises a projected reinforcing portion 21, a recess 12 is formed in the housing 10 at a position corresponding to the projected reinforcing portion 21, and the recess 12 comprises a recess projection 13 at a bottom surface of the recess 12. As shown in the figure, the projected reinforcing portion 21 is a reinforcing rib on the planar sheet body, and provides a better effect in shape maintaining when being heated. The recess 12 and the recess projection 13 correspondingly formed in the housing 10 help the projected reinforcing portion 21 to resist bending and spring back.

Figure 6:
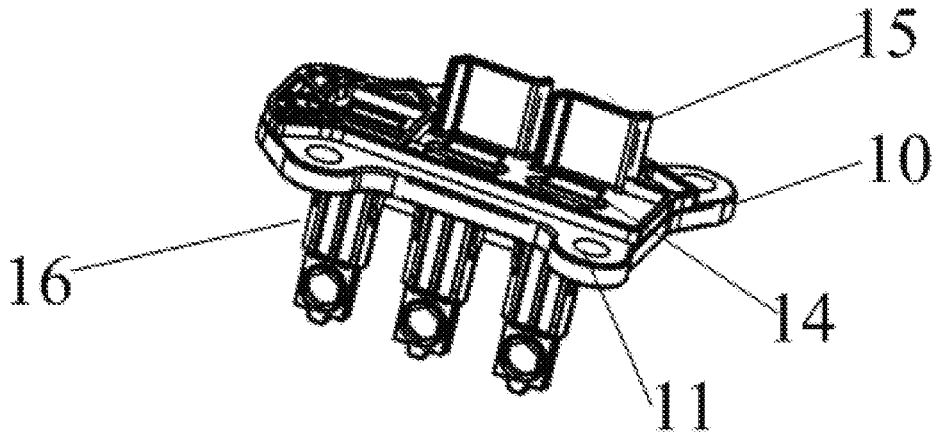
FIG. 6 is a schematic diagram of a housing.

As about the copper bar for electric conduction, the copper bar comprises at least two copper sheets 31, as shown in FIG. 1, the number of the copper sheets 31 in the embodiment of the present application is three, but it is also within the scope of the present application that the number of the copper sheets 31 is more or less than three, as long as the purpose of electric conduction can be achieved; as shown in FIG. 6, a stepped through hole 14 is formed in the housing 10 at a position where the housing is connected to each copper sheet 31, and the stepped through hole 14 has a larger diameter at an upper side than that at a lower side. The copper sheets 31 pass through and are connected to the stepped through holes 14, and the parts, at the lower sides with a smaller diameter, of the stepped through holes 14 are tightly connected to the copper sheets 31.

Further, as shown in FIG. 1, the high-voltage connector further comprises at least two sealing rings 40 and at least two sealing gaskets 50, wherein the sealing rings 40 and the sealing gaskets 50 are connected to the upper sides of the stepped through holes 14, the copper sheets 31 are inserted into and connected to the sealing rings 40 and the sealing gaskets 50, the sealing gaskets 50 are tightly connected to the stepped through holes 14, and the sealing rings 40 and the sealing gaskets 50 have the same number as the copper sheets 31. As shown in the figure, the copper sheets 31 are firstly inserted into the sealing gaskets 50 and then inserted into the sealing rings 40, and at positions where the sealing rings 40 are connected to the stepped through holes 14, raised connection clamping parts are provided; after being connected, the sealing gaskets 50 are tightly connected to the stepped through holes 14 such that the sealing rings 40 and the copper sheets 31 can be tightly sealed in the stepped through holes 14, and oil in the box body cannot leak out through the stepped through holes 14.

Preferably, referring to FIGS. 1 and 6, the housing 10 further comprises at least two partition ribs 15, the number of the partition ribs 15 is configured mainly with reference to the number of the copper sheets 31, and the number of the partition ribs 15 may be less than the number of the copper sheets 31. As shown in the figures, in this embodiment, the number of the partition ribs 15 is two, and the number of the copper sheets 31 is three, but it is not intended to limit the present application, and should be within the scope of protection of the present application as long as the protection effect can be achieved. Each partition rib 15 is an L-shaped sheet projected from the housing 10, and the partition ribs 15 are located at the upper sides of the stepped through holes 14 at positions corresponding to the copper sheets 31. The purpose of providing the partition ribs 15 is to protect the copper sheets 31 from being touched by mistake.

Figure 7:
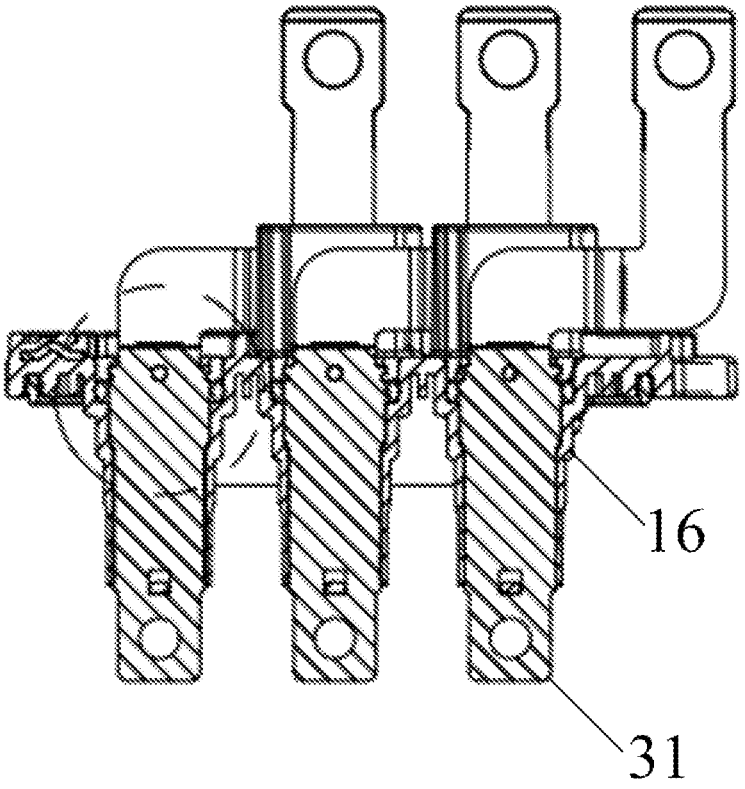
FIG. 7 is a schematic diagram illustrating connection of copper sheets and slide grooves.
Figure 8:
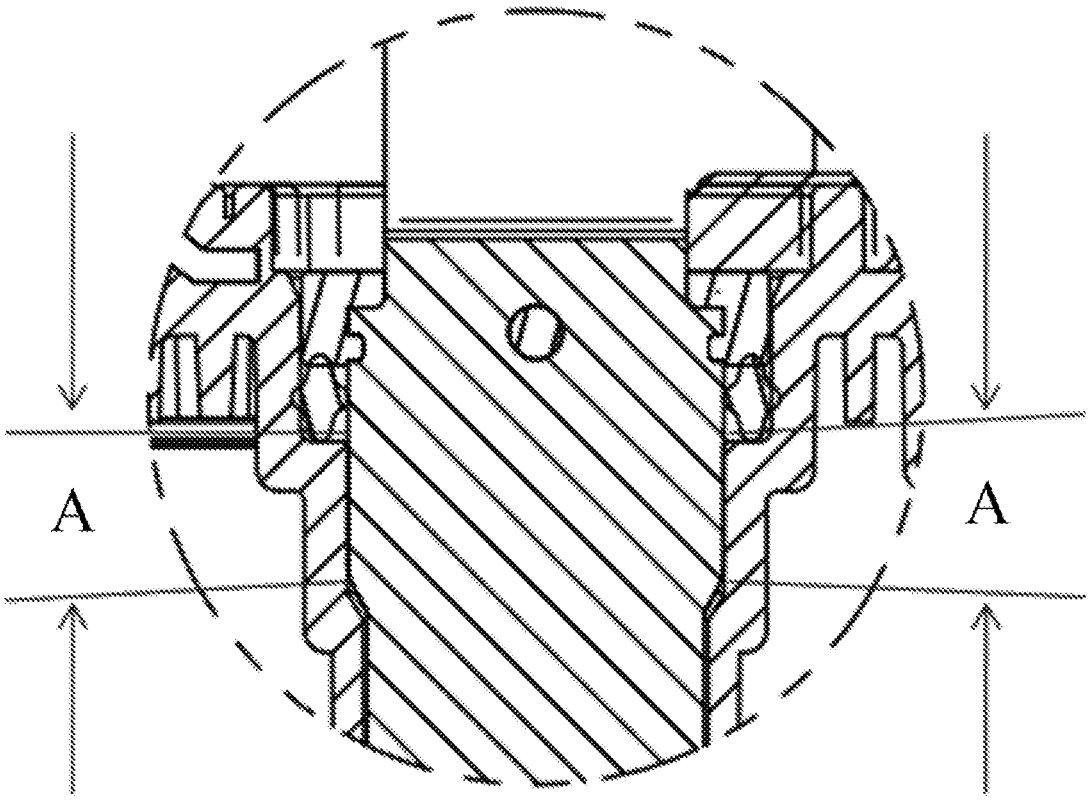
FIG. 8 is an partially enlarged schematic diagram of FIG. 7.

Preferably, referring to FIGS. 1 and 6, the housing 10 further comprises at least two slide grooves 16, the number of the slide grooves 16 is configured mainly with reference to the number of the copper sheets 31, each copper sheet 31 corresponding to one slide groove 16. As shown in the figures, the number of the slide grooves 16 in the present application is three, but it is not intended to limit the present application; each slide groove 16 is a concave sheet projected from the housing 10, and the slide grooves 16 are located at the lower sides of the stepped through holes 14 at positions corresponding the copper sheets 31. The copper sheets 31 enter the slide grooves 16 after passing through the housing 10, and smoothly reach circuit connection positions with the guide of the slide grooves 16. Referring to FIGS. 7 and 8, the slide grooves 16 and the copper sheets 31 are in an interference fit, as shown in FIG. 8, within a distance marked by A, the copper sheets 31 and the slide grooves 16 have an interference fit of 0-0.3 mm, so that the copper sheets 31 are prevented from shaking in the housing, the precision of mounting holes is improved, and the mounting is facilitated. Circuit mounting holes are formed in upper and lower sides of the copper sheets 31, and the positions of the holes must be well defined before mounting such that the copper sheets 31 are positioned in the up-down direction by the sealing gaskets 50 and positioned in the left-right direction by the interference fit with the slide grooves 16 before mounting, and can be fixed after mounting.

In summary, with friction force of the sealing gaskets 50, friction force of the stepped through holes 14 and friction force of the slide grooves 16, the copper sheets 31 are stably assembled on the housing 10 and prevented from falling off or misposition; the housing 10 embraces and is connected to the reinforcing sheet 20, so that the housing 10 can thermally expand when the transmission works and recover to the original size in a non-working state, and after long-time working, the housing would not deform due to insufficient strength, which causes seal failure and undesirable oil leakage, and the dimensional stability is good.

In summary, due to the above technical features, compared with the prior art, the present invention has the following advantages and beneficial effects:

firstly, the transmission high-voltage connector of the present application is simple in structure, and the reinforcing sheet increases the strength and provides high-temperature deformation resistance; and secondly, with the design of the stepped through holes and the slide grooves, the assembly is simplified, and the reliability is increased.

The preferred embodiments of the present invention are provided merely to assist in illustrating the present invention. The preferred embodiments are not intended to be exhaustive or to limit the present invention to the particular embodiments described. Obviously, many modifications and variations are possible in light of the above teachings. The embodiments were chosen and described in detail in order to best explain the principles of the present invention and its practical application to thereby enable others skilled in the art to best utilize the present invention. The present invention is limited only by the claims and their full scope and equivalents. The foregoing disclosure is only of the preferred embodiments of the invention and is not intended to be limiting thereof, equivalent changes and modifications made by those skilled in the art without departing from the spirit of the invention are within the scope of the invention.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A transmission high-voltage connector for circuit connection of a transmission of a new-energy vehicle, the transmission comprising a box body and a high-voltage connector covering an opening of the box body, wherein the high-voltage connector comprises a housing, at least one reinforcing sheet and a copper bar, and the copper bar is inserted into and connected to the housing; wherein, the housing is an N-sided polygon that has N side lines, and at most N-1 fixing holes are formed in the housing at positions where two side lines of the housing are connected; and at positions where two side lines are connected while no fixing hole is formed, the housing embraces and is connected to the reinforcing sheet, wherein the reinforcing sheet comprises a projected reinforcing portion, a recess is formed in the housing at a position corresponding to the projected reinforcing portion, and the recess comprises a recess projection at a bottom surface of the recess.

2. The transmission high-voltage connector according to claim 1, wherein the reinforcing sheet is a spring metal sheet forming an angle.

3. The transmission high-voltage connector according to claim 1, wherein the copper bar comprises at least two copper sheets, a stepped through hole is formed in the housing at a position where the housing is connected to each copper sheet, and the stepped through hole has a larger diameter at an upper side than at a lower side.

4. The transmission high-voltage connector according to claim 3, further comprising at least two sealing rings and at least two sealing gaskets, wherein the sealing rings and the sealing gaskets are connected to the upper sides of the stepped through holes, the copper sheets are inserted into and connected to the sealing rings and the sealing gaskets, and the sealing gaskets are tightly connected to the stepped through holes.

5. The transmission high-voltage connector according to claim 3, wherein the housing further comprises at least two partition ribs each of which is an L-shaped sheet projected from the housing, and the partition ribs are located at the upper sides of the stepped through holes at positions corresponding to the copper sheets.

6. The transmission high-voltage connector according to claim 3, wherein the housing further comprises at least two slide grooves each of which is a concave sheet projected from the housing, and the slide grooves are located at the lower sides of the stepped through holes at positions corresponding the copper sheets.

* * * * *